US007227475B1

(12) United States Patent
Provenzano et al.

(10) Patent No.: US 7,227,475 B1
(45) Date of Patent: Jun. 5, 2007

(54) PUBLIC TRANSPORTATION INTERACTIVE GEOGRAPHICAL ADVERTISEMENT SYSTEM HAVING WORLD WIDE WEB ACCESS

(76) Inventors: Giorgio Provenzano, 5727 Tuscany Ter., Tamarac, FL (US) 33321-4461; Vincenzo DiBello, 5727 Tuscany Ter., Tamarac, FL (US) 33321-4461

( * ) Notice: Subject to any disclaimer, the term of this patent is extended or adjusted under 35 U.S.C. 154(b) by 184 days.

(21) Appl. No.: 11/105,726

(22) Filed: Apr. 13, 2005

(51) Int. Cl.
*G08G 1/123* (2006.01)

(52) U.S. Cl. ..... 340/995.24; 340/995.12; 701/213

(58) Field of Classification Search ..... 340/995.12, 340/995.13, 995.24, 995.19, 995.27; 701/207, 701/208, 211, 213
See application file for complete search history.

(56) References Cited

U.S. PATENT DOCUMENTS

| | | | | |
|---|---|---|---|---|
| 4,754,582 | A | 7/1988 | Cameron | |
| 5,150,116 | A | 9/1992 | West | |
| 5,572,653 | A | 11/1996 | DeTemple et al. | |
| 5,579,535 | A * | 11/1996 | Orlen et al. | 455/421 |
| 5,915,020 | A | 6/1999 | Tilford et al. | |
| 6,014,090 | A * | 1/2000 | Rosen et al. | 340/905 |
| 6,138,072 | A * | 10/2000 | Nagai | 701/207 |
| 6,219,696 | B1 | 4/2001 | Wynblatt et al. | |
| 6,414,602 | B2 | 7/2002 | Polyakov | |
| 6,484,148 | B1 | 11/2002 | Boyd | |
| 6,701,143 | B1 * | 3/2004 | Dukach et al. | 455/414.2 |
| 6,714,797 | B1 * | 3/2004 | Rautila | 445/552.1 |
| 6,798,358 | B2 * | 9/2004 | Joyce et al. | 340/995.24 |
| 6,989,770 | B1 * | 1/2006 | Painter | 340/995.12 |
| 7,035,731 | B2 * | 4/2006 | Smith | 701/207 |
| 7,177,634 | B2 * | 2/2007 | Wang et al. | 455/420 |
| 2002/0049535 | A1 * | 4/2002 | Rigo et al. | 701/211 |
| 2002/0072848 | A1 * | 6/2002 | Hamada et al. | 701/211 |
| 2003/0163233 | A1 * | 8/2003 | Song et al. | 701/33 |
| 2003/0191578 | A1 * | 10/2003 | Paulauskas et al. | 701/200 |
| 2003/0201914 | A1 * | 10/2003 | Fujiwara et al. | 340/995.24 |
| 2005/0023899 | A1 * | 2/2005 | Kitazawa | 307/10.1 |

FOREIGN PATENT DOCUMENTS

| | | |
|---|---|---|
| EP | 0.853.287 | 7/1998 |
| GB | 2.344.009 | 5/2000 |
| WO | WO97/27546 | 7/1997 |

* cited by examiner

*Primary Examiner*—Brent A. Swarthout
(74) *Attorney, Agent, or Firm*—Michael I Kroll

(57) ABSTRACT

A information providing system for use in a vehicle. The system includes a processor having a global positioning system (GPS) incorporated therein positioned at a predetermined location within said vehicle. A passenger interface is positioned within the vehicle and connected to the processor for controlling the processor. A service provider is located remotely from the vehicle for storing and selectively distributing content to the processor. A communication network connects the service provider to the processor. The GPS obtains information regarding a geographic location of the vehicle and provides the information to the service provider for analysis thereof. The service provider parses the stored content and distributes geographically pertinent content to the processor for display on the passenger interface.

16 Claims, 15 Drawing Sheets

PUBLIC TRANSPORTATION INTERACTIVE GEOGRAPHICAL ADVERTISEMENT SYSTEM HAVING WORLD WIDE WEB ACCESS

BACKGROUND OF THE INVENTION

1. Field of the Invention

The present invention relates generally to a computer system and, more specifically, to a system and apparatus for providing passengers on public conveyances with local information regarding goods and services located within a predetermined geographic area. The users of the system are able to interact with provided services or surf the internet using a display device and a tactile means for interacting with the displayed material. Additionally, the system provides means to communicate with the driver using language translation software. The system of the present invention is designed for use in at least one of a taxi cab, public bus, airplane, commuter railroad and subway.

2. Description of the Prior Art

There are other communication devices designed for portable computing. Typical of these is U.S. Pat. No. 4,754,582 issued to Cameron on Jul. 5, 1988.

Another patent was issued to West on Sep. 22, 1992 as U.S. Pat. No. 5,150,116. Yet another U.S. Pat. No. 5,572,653 was issued to DeTemple, et al. on Nov. 5, 1996 and still yet another was issued on Jun. 22, 1999 to Tilford, et al. as U.S. Pat. No. 5,915,020.

Another patent was issued to Wynblatt et al. on Apr. 17, 2001 as U.S. Pat. No. 6,219,696. Yet another U.S. Pat. No. 6,414,602 was issued to Polyakov on Jul. 2, 2002. Another was issued to Boyd on Nov. 19, 2002 as U.S. Pat. No. 6,484,148 and still yet another was issued on Mar. 2, 2004 to Dukach et al. as U.S. Pat. No. 6,701,143.

Another patent was issued to Rautila on Mar. 30, 2004 as U.S. Pat. No. 6,714,797. Yet another International Patent Application No. WO97/27546 was published to Payne on Jul. 31, 1997. Another was issued to Tuttlebee on May 24, 2000 as U.K. Patent No. GB2344009 and still yet another was published on Jul. 15, 1998 to Karl as European Patent Application No. EP0853287.

U.S. Pat. No. 4,754,582

Inventor: Robert J. Cameron

Issued: Jul. 5, 1988

A telephone booth wherein the sidewalls are box-like enclosures each having one or more advertising displays. The displays are illuminated by a light source located in the interior of each enclosure and the same light source also serves to illuminate the interior of the booth. The sidewall enclosures have an openable panel which permits the advertising displays to be changed from time to time as well as permitting access to the light source.

U.S. Pat. No. 5,150,116

Inventor: Harold B. West

Issued: Sep. 22, 1992

A traffic light timed advertising center includes an advertising display device, such as an electronic message center or other visual display device for displaying alpha-numeric and symbolic advertising messages, in which the advertising messages can be made selectively visible and invisible to drivers, is positioned adjacent a traffic control signal device having alternative signal phases for sequentially stopping and permitting the flow of traffic. A display control device, including an electronic control signal, coordinates the advertising display device with the traffic control signal device to make the advertising message invisible to drivers at selected times, particularly during transitions of the traffic control signal device from one signal phase to another, during a particular phase, and for predetermined time intervals before or after the transition from one phase to another, as desired or appropriate to display the advertising message only during times of the traffic control signal device phases when drivers' attentions to the advertising message will not adversely affect the drivers' attentions to required driving functions.

U.S. Pat. No. 5,572,653

Inventor: William C. DeTemple

Issued: Nov. 5, 1996

A system for communicating between a store computer and locations in the aisles of a retail facility. A hard wired grid connects the store computer to a plurality of transceivers located in zones throughout the facility and the transceivers establish a wireless link to the locations. One embodiment is a product information display system in which the locations are fixed information display terminals, such as price displaying shelf tags. Another embodiment is an item tracking system, in which the locations are movable shopping carts or baskets.

U.S. Pat. No. 5,915,020

Inventor: Arthur R. Tilford, et al.

Issued: Jun. 22, 1999

A portable device for receiving satellite signals and displaying the signals as video. Preferably, the device includes a portable supporting member such as a hinged enclosure case, a satellite antenna, and a display monitor. The satellite antenna is preferably of a flat configuration and is mounted to the support, and the display monitor is preferably a flat video screen mounted to the same support. The required satellite receiver electronics and video decoder may be mounted to the portable support and powered by one or more batteries to provide an integrated and easily transported system to receive and view video relayed by satellite. A PCMCIA card slot and a microcontroller can be provided with the device to provide additional features such as cellular modem use, PCS wireless access, RS-232 port emulation, or GPS position location.

U.S. Pat. No. 6,219,696

Inventor: Michael Wynblatt

Issued: Apr. 17, 2001

An Actively Broadcast URLs for Drive-By Internet Information (ABU-DaBII) system provides for the just-in-time distribution of information through mobile information terminals. The system involves the Internet as the primary source of the information and includes a mobile information terminal as the output device and a local agent which is locally operated. The mobile information terminal includes a receiver, a URL queue and a WWW renderer/browser. The local agent includes a short-range transmitter to distribute information pointers to the mobile information terminal and a mechanism for transferring data into the transmitter.

U.S. Pat. No. 6,414,602

Inventor: Lenny Polyakov

Issued: Jul. 2, 2002

A system of advertising has a source of advertising information adapted to transmit advertising informations of different contents substantially corresponding to objects to be advertised situated in different advertising zones and formed as a server unit, a plurality of moving vehicles, each of the vehicles being provided with a receiver for receiving the advertising informations of different contents, each of the vehicles being provided with further unit for receiving a signal which does not contain advertising information, each of the vehicles being provided with vehicle location determination allowing unit adapted to allow determination of a location of a respective one of the vehicles, each of the vehicles being provided with a display for displaying advertising information, and the server unit determining a zone in which the vehicle is located and transmitting to the further receiving unit of the vehicle the signal which does not contain advertising information to select in a vehicle and display on the display a corresponding advertising information with a content which corresponds to the determined zone.

U.S. Pat. No. 6,484,148

Inventor: John E. Boyd

Issued: Nov. 19, 2002

Electronic advertising devices and methods of using the same for providing targeted advertisements to one or more individuals based on the individual(s) consumer profile(s). The devices or systems include a sensor or receiver for receiving identifying signals from individuals such as signals emitted by cellular telephones. Using information associated with or retrieved using the identifying signal, targeted advertisements are delivered to the individuals.

U.S. Pat. No. 6,701,143

Inventor: Semyon Dukach, et al.

Issued: Mar. 2, 2004

A system of advertising information on one or more mobile vehicles as a function of the vehicle's location. The system comprises mobile units and a central system for controlling the displays on the mobile units. The mobile units include displays visible from the outside of the vehicle, a controller, and a wireless communication system for repeatedly transmitting a locator signal to and receiving display-selection messages from the central system. The central system includes a wireless communication system for receiving locator signals from the mobile units, a memory and a processor. The central system determines a zone in which the mobile unit is located, selects a display to be shown by the mobile unit based on the zone that the mobile unit is located, and transmits a display-selection message to the mobile unit identifying a selected display message to be shown on the mobile unit's display.

U.S. Pat. No. 6,714,797

Inventor: Heikki Rautila

Issued: Mar. 30, 2004

A system, method and computer program for ordering, paying for and download digital products to a mobile device in a cost-effective manner. The mobile device includes a short range transceiver and a network transceiver. The mobile device accesses electronic shop server web sites which contain digital products for sale and hotspot network locations where these digital products may be downloaded to the mobile device via the short range transceiver. The hotspot network locations contain a hotspot device for transmitting the digital products to the mobile devices via the low power radio frequency signal of the short range transceivers when the mobile device has detected the low power radio frequency signal. Using this system, method and computer program, a user of a mobile device may download large amounts of digital data without incurring telephone or cellular phone charges.

International Patent Application Number WO97/27546

Inventor: John M. Payne

Published: Jul. 31, 1997

A system and method for data communication connecting on-line networks with on-line and off-line computers. The present system provides for broadcast of up to the minute notification centric information thereby providing an instant call to action for users who are provided with the ability to instantaneously retrieve further detailed information. The notification centric portions of information (26, 28) are wirelessly broadcast (36) to wireless receiving devices (18) which are attached to computing devices (14). Upon receipt of the information at the personal computer (14), the user is notified through different multimedia alerts that there is an incoming message. Wirelessly broadcasted URL's, associated with the data, are embedded in data packets and provide an automated wired or wireless connection (22) back to the information source (12) for obtaining detailed data.

U.S. Patent Number GB2344009

Inventor: Walter Harold William Tuttlebee

Published: May 24, 2000

A TV, radio, DBS decoder or mobile phone enables advertising and programme broadcasts to be selectively displayed on the basis of receiver location or a user profile. The receiver determines its location by means of GPS, LORAN or by use of a cellular telephone. The receiver determines the user profile by interrogation. The receiver filters the received broadcast programmes and adverts for selective display according to the receiver location or user profile. The apparatus may be used in conjunction with a UMTS subscriber unit.

European Patent Application Number EP0853287

Inventor: Janne Karl

Issued: Jul. 15, 1998

Method for transmission of information to the user, in which a search terminal (1) is used for sending an information query, which is received and processed. Further in the method, information is searched for, and the retrieved information is transmitted to the search terminal (1). The information is received and displayed to the user by the search terminal (1). A system for transmitting information to a user comprises a search terminal (1) for sending an information query, means (3, 4, 4', 4") for receiving and processing of the information query, means (3, 4, 4', 4") for retrieving information, means (2) for transmitting the information to the search terminal (1), and means (1) for receiving the information and presenting it to the user on the search terminal (1), The information retrieval is arranged to be conducted at least partly on the basis of the location and/or travel route of the user.

While these systems may be suitable for the purposes for which they were designed, they would not be as suitable for the purposes of the present invention, as hereinafter described.

SUMMARY OF THE PRESENT INVENTION

The present invention relates generally to a computer system and, more specifically, to a system and apparatus for providing passengers on public conveyances with local information regarding goods and services located within a predetermined geographic area. The users of the system are able to interact with provided services or surf the internet using a display device and a tactile means for interacting with the displayed material. Additionally, the system provides means to communicate with the driver using language translation software. The system of the present invention is designed for use in at least one of a taxi cab, public bus, airplane, commuter railroad and subway.

A primary object of the present invention is to provide an interactive public transportation information system that overcomes the shortcomings of the prior art.

Another secondary object of the present invention is to provide an interactive public transportation information system wherein passengers of public conveyances are able to access to information related to the goods and services provided within a geographical area.

Another object of the present invention is to provide an interactive public transportation information system wherein the information accessed by the passengers includes but is not limited to local news, weather, sports, traffic, local merchants, local activities and local service providers.

An even further object of the present invention is to provide an interactive public transportation information system wherein the information accessed is obtained via accessing the world wide web.

Another object of the present invention is to provide an interactive public transportation information system having a broadband Internet capable computer system connected to at least one display.

Still another object of the present invention is to provide an interactive public transportation information system wherein the computer system is positioned in a predetermined location remote from the at least one display.

Yet another object of the present invention is to provide an interactive public transportation information system further including a tactile device connected to the computer system for controlling the system to access all services provided thereby.

Another object of the present invention is to provide an interactive public transportation information system wherein the display and tactile device form the customer interface for the system of the present invention.

An even further object of the present invention is to provide an interactive public transportation information system wherein the customer interface is utilized by the passenger for accessing the information provided by the system of the present invention.

Yet another object of the present invention is to provide an interactive public transportation information system wherein the display monitor centrally positioned within the backside of the front seat having a fold down tactile device that can additionally provide other tactile devices, such as a key pad incorporating a touch pad cursor control.

Still yet another object of the present invention is to provide an interactive public transportation information system wherein the tactile means includes at least one of touchscreen, keypad, keyboard, mouse, and stylus.

Another object of the present invention is to provide an interactive public transportation information system including means to communicate with the driver using language translation software.

Yet another object of the present invention is to provide an interactive public transportation information system able to process transactions using a card reader.

Still an even further object of the present invention is to provide an interactive public transportation information system wherein the information provided thereby is at least one of pay-per-transaction, fee based and no charge.

Another object of the present invention it to provide an interactive public transportation information system including a central server located a remote location wherein the provided information is selectively distributed to a plurality of public conveyances.

Still a further object of the present invention is to provide an interactive public transportation information system wherein the information is provided over a communication network.

Yet another object of the present invention is to provide an interactive public transportation information system wherein the communication network is at least one of satellite system, wireless internet connections and wi-fi hotspots.

Another object of the present invention is to provide an interactive public transportation information system that is simple and easy to use.

An even further object of the present invention is to provide an interactive public transportation information system that is economical to manufacture.

Additional objects of the present invention will appear as the description proceeds.

The present invention overcomes the shortcomings of the prior art by providing means and apparatus whereby passengers of public conveyances can interact with provided services or surf the Internet using a display device and a tactile means for interacting with the displayed material.

The display and tactile means form the customer interface of an on-board Internet capable computer system designed primarily for providing information related to the goods and services provided within a geographical area, links to local news, weather, sports, traffic etc. and access to the world wide web.

The present invention, in one embodiment, provides for a display monitor centrally positioned within the backside of the front seat having a fold down tactile device that can additionally provide other tactile devices, such as a key pad incorporating touch pad cursor control. Additionally provided for is language translation software to facilitate communication between the occupants and driver.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 14:
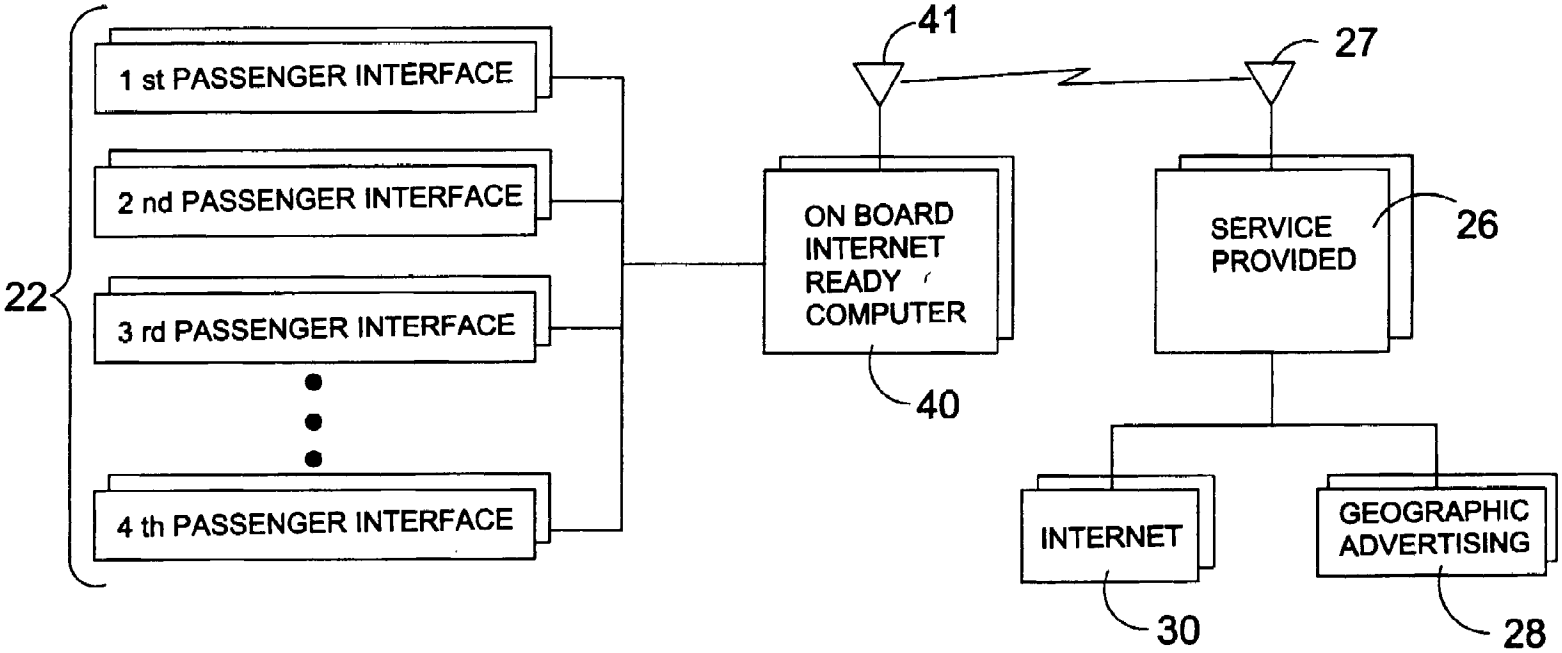

FIG. 14 a block diagram of the communication system of the interactive public transportation information system of the present invention; and.

Figure 15:
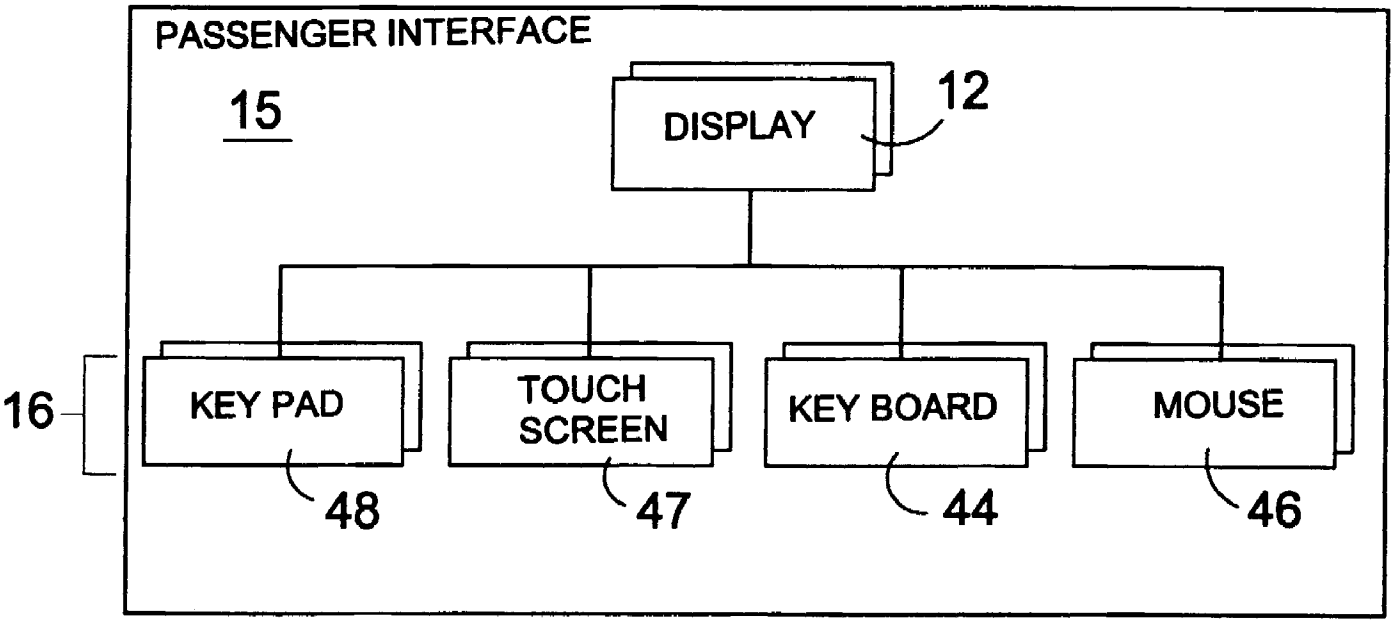

FIG. 15 is a block diagram of the user interface of the interactive public transportation information system of the present invention.

DESCRIPTION OF THE REFERENCED NUMERALS

Turning now descriptively to the drawings, in which similar reference characters denote similar elements throughout the several views, the Figures illustrate the interactive public transportation information system of the present invention. With regard to the reference numerals used, the following numbering is used throughout the various drawing Figures.

10 system of the present invention
11 user
12 display
14 payment mechanism
16 input device
18 railroad train
20 bus
21 front seat of vehicle
22 automobile
23 back seat of vehicle
24 airplane
26 service provider
28 remote advertising server
30 internet
32 communication network
34 data signal
36 vehicle trunk
38 wires
40 processor
42 objects of the system
44 keyboard
46 mouse
47 touch screen
48 keypad
50 voice command module
52 vehicle GPS system
54 type of public transportation
56 other vehicles
58 benefits of the system of the present invention
60 advertisement methods
62 payment methods

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 8 illustrate the interactive public transportation information system of the present invention which is indicated generally by the reference numeral 10 and referred to hereinafter as "system".

Figure 1:
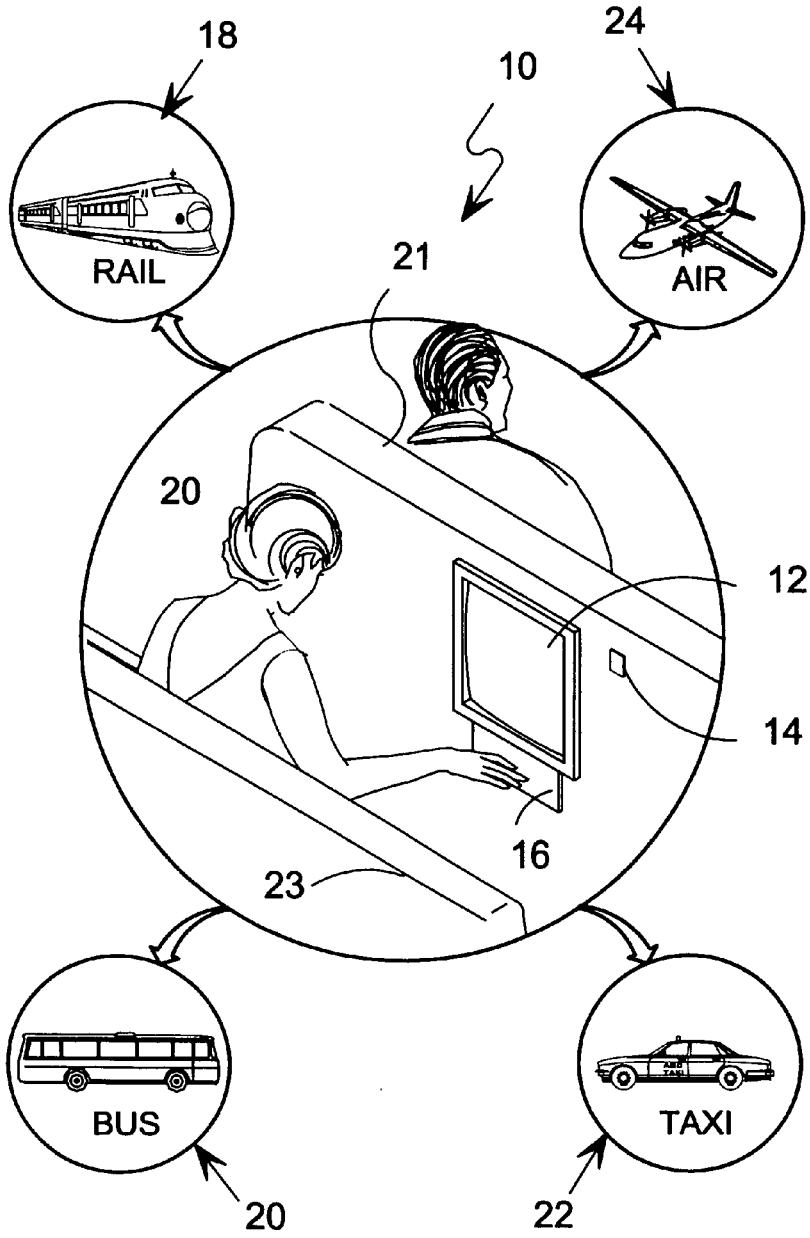
FIG. 1 is an illustrative view of the interactive public transportation information system of the present invention.

FIG. 1 is an illustrative view of the interactive public transportation information system of the present invention. The goal of the system 10 of the present invention is to interactively provide information to a user that is traveling using a municipal public and/or private transportation system. Preferably, the system 10 of the present invention is used in the public transportation realm as shown herein in FIG. 1. Specifically, the system 10 of the present invention maybe incorporated for use in at least one of automobile 22, a bus 20, a train 18 and an airplane 24. These vehicles are described for purposes of example only and any vehicle able to transport people between at least two locations can utilize the system 10 of the present invention.

FIG. 1 shows the system 10 of the present invention in an embodiment used in a automobile 22, such as a taxi. FIGS. 1–15 describe the system 10 of the present invention as shown in an automobile. However, it should be known that the system 10 of the present invention as described herein is useable within any vehicle. The automobile 22 includes a front seat 21 and a back seat 23 within an interior cabin thereof. The front seat has a back side 25 wherein the system 10 of the present invention is positioned for use by the user 11 sitting in the back seat 23.

Figure 3:
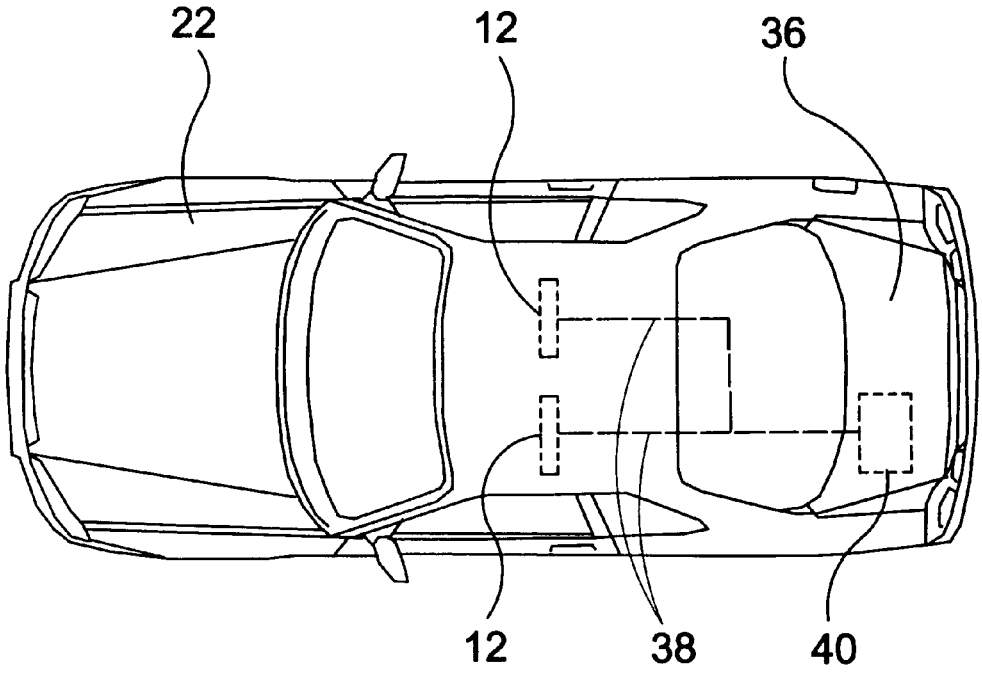
FIG. 3 is a top view of a vehicle including the interactive public transportation information system present invention on board.

The system 10 of the present invention includes a display 12 and a user interface 16 located proximate to the display 12. The user interface 16 allows the user to interact with the system 10 of the present invention and will be described hereinafter with respect to FIGS. 7 and 15. Additionally, the system 10 includes a payment device 14 positioned proximate to at least one of the display 12 and the user interface 16. The payment device 14 is an optional feature of the system 10 of the present invention. Upon the payment device 14 being activated, a user is able to provide billing information via a credit card or other payment means in order to access the system 10 of the present invention. Each of the display 12, user interface 16 and the payment device 14 are connected to a processor 40 as shown in FIG. 3 which is positioned at a predetermined location within the vehicle 22. The processor 40 includes a transceiver able to communicate with a remote source of information such as a service provider and the internet. The processor 40 selectively receives information that is geographically pertinent to the respective vehicle 22 in which the system 10 is installed. The processor 40 then provides the information received thereby for display in display 12 whereby the user 11 can selectively view the information. The user 11 may also use the interface 16 to manipulate and navigate through the provided information being displayed on the display 12. The user interface 16 communicates with the processor 40 to change and/or select new other information to be provided by the system 10 of the present invention.

The information provided by the system, as stated above is geographically pertinent to the vehicle 22. Therefore, the information provided by the system 10 includes but is not limited to local mechants, local service providers, event information, maps, news, traffic information and advertisements. The above categories of provided information are described for purpose of example only and may include other information that is geographically pertinent to the vehicle 22 in which the user is traveling.

The present invention utilizes public transportation to provide broadband communication services to consumers. The system provides both, free service communications and informational services, and paid services through which the user may gain access to the World Wide Web. The manner in which the information is provided to the user 11 will be discussed hereinafter.

Figure 2:
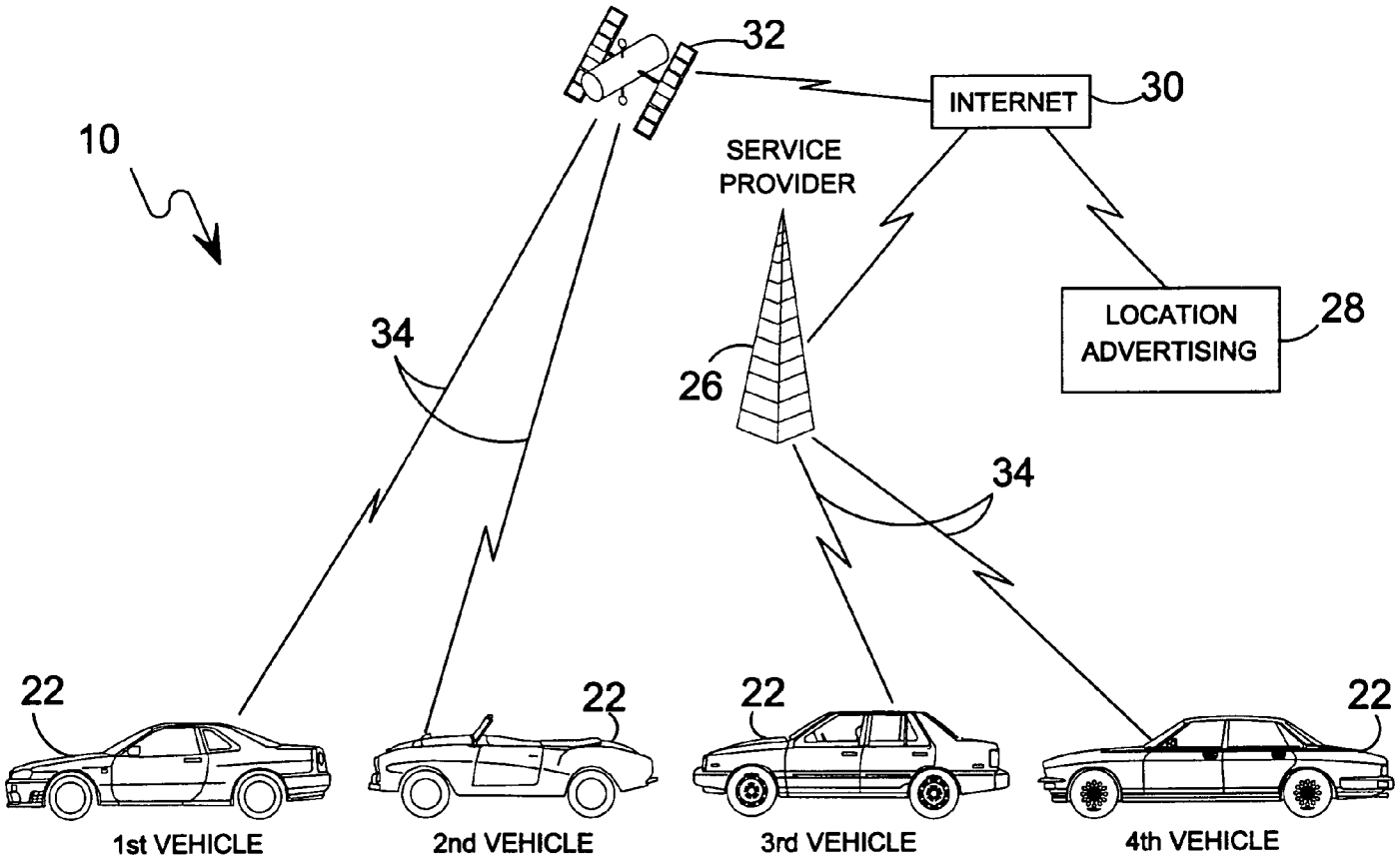
FIG. 2 is an illustration of the communication system of the interactive public transportation information system of the present invention.

FIG. 2 is an illustration of the communication system of the interactive public transportation information system of the present invention. As described above with respect to FIG. 1, the system 10 of the present invention provides a plurality of types of information to a user when the user is riding in a public transportation vehicle. FIG. 2 shows how the system 10 of the present invention obtains, transmits and provides information to a plurality of vehicles. Specifically, shown herein there are four vehicles 22 that may be part of a fleet of public transportation vehicles. The fact that only four vehicles 22 are shown herein does not mean to limit the use of the system to four vehicles 22. The system 10 can be designed to incorporate any number of vehicles 22.

In addition to the in-vehicle components described above with respect to FIG. 1, the system 10 of the present invention further includes a remote server 28 and a service provider 26. Each of the remote server 28 and the service provider 26 are connected to one another as well as to an external communication network 32 by the internet. Preferably, the connections between each of the remote server 28, the service provider 26, the internet 30, the communication network 32 and each of the vehicles 22 is a high-speed broadband connection able to quickly and reliably transfer data therebetween.

The service provider 26 is the initial distribution point for the information being provided to the vehicles 26. The remote server 28 includes a storage mechanism and/or a database having information stored therein which is then provided, by the service provider 26, to at least one of a plurality of vehicles and to an external communication network 32. The remote server 28 includes a plurality of predetermined rules which govern the type of information provided by the system 10 of the present invention.

Additionally, the system 10 includes a global positioning system (GPS) whereby each of the vehicles 22 have a GPS receiver which is in constant communication with a GPS satellite for selectively determining the geographical location of each respective vehicle 22. The position of each vehicle is provided to the service provider which then in turn accesses the remote server 28 to retrieve information based on the geographic location. Upon retriving the geographically pertinent information from the remote server 28, the service provider 26 provides the information to the vehicle via data signals 34 wherein each respective data signal provided represents specifically requested information. The system is designed such that the service provider 26 and remote server 28 are able to handle multiple simultaneous requests from a plurality of users 11 in a plurality of vehicles.

In addition to pertinent geographic information, the system 10 of the present invention provides a user with internet access.

Furthermore, if the system 10 of the present invention is a pay-per-use system, the service provider 26 receives and processes the payment information input by the user 11 and selectively verifies that a payment is made. Thereafter, the service provider 26 function as described hereinabove and provides at least one of geographically pertinent information and internet access to a user in a respective one of a plurality of vehicles.

FIG. 3 is a top view of a vehicle including the interactive public transportation information system present invention on board. The vehicle 22 includes the system 10 of the present invention. The system 10 as shown herein includes a plurality of displays 12 and corresponding user interfaces 16 for each. Each display 12 and corresponding user interface 16 is connected via connection wires 38 to the processor 40. The processor 40 may be formed as a personal computer having any and all necessary computing parts installed therein for sending, receiving and processing data received thereby. Preferably, the processor 40 allows for graphical display of the received geographically pertinent information on each respective display 12. The processor 40 also includes GPS receiver for communicating a position of the vehicle to a GPS satellite. The receiver may be formed integral with the processor or may be an external unti connected to the processor 40. Additionally, the processor 40 should be able to independently process inputs from each respective user interface 16 in the vehicle 22. Thus, the system 10, as shown in FIG. 3, allows for multiple users to use the system independently from one another.

The processor 40 provides onboard broadband internet to the user as well as receives information related to the goods and services provided within a geographical area such as, but not limited to, links to local news, weather, sports, traffic etc. and access to the world wide web. The system provides both, free service communications and informational services, and paid services through which the user may gain access to the World Wide Web.

Figure 4:
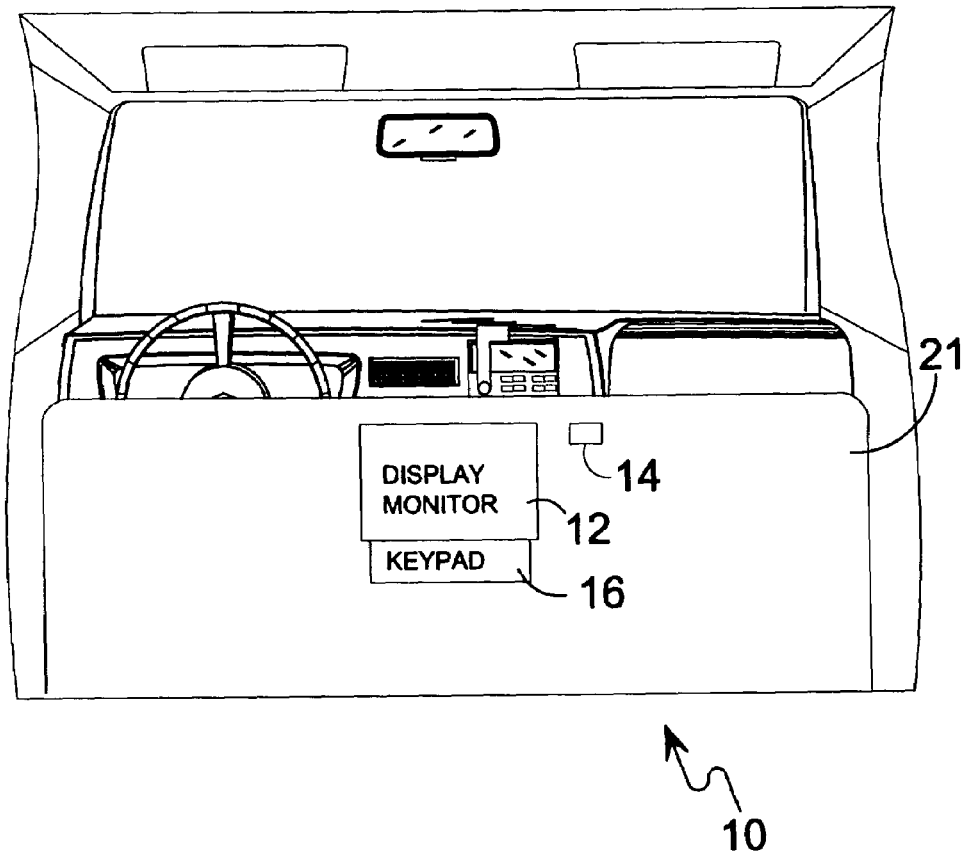
FIG. 4 is a front view of the display and tactile interface of the interactive public transportation information system of the present invention.

FIG. 4 is a front view of the display and tactile interface of the interactive public transportation information system of the present invention. The system 10 of the present invention includes a display 12 and a user interface 16 located proximate to the display 12. The user interface 16 allows the user to interact with the system 10 of the present invention and will be described hereinafter with respect to FIGS. 7 and 15. Additionally, the system 10 includes a payment device 14 positioned proximate to at least one of the display 12 and the user interface 16. The payment device 14 is an optional feature of the system 10 of the present invention. Upon the payment device 14 being activated, a user is able to provide billing information via a credit card or other payment means in order to access the system 10 of the present invention. Each of the display 12, user interface 16 and the payment device 14 are connected to a processor 40 as shown in FIG. 3 which is positioned at a predetermined location within the vehicle 22. The processor 40 includes a transceiver able to communicate with a remote source of information such as a service provider and the internet. The processor 40 selectively receives information that is geographically pertinent to the respective vehicle 22 in which the system 10 is installed. The processor 40 then provides the information received thereby for display in display 12 whereby the user 11 can selectively view the information. The user 11 may also use the interface 16 to manipulate and navigate through the provided information being displayed on the display 12. The user interface 16 communicates with the processor 40 to change and/or select new other information to be provided by the system 10 of the present invention.

The information provided by the system, as stated above is geographically pertinent to the vehicle 22. Therefore, the information provided by the system 10 includes but is not limited to local mechants, local service providers, event information, maps, news, traffic information and advertisements. The above categories of provided information are described for purpose of example only and may include other information that is geographically pertinent to the vehicle 22 in which the user is traveling.

The present invention utilizes public transportation to provide broadband communication services to consumers. The system provides both, free service communications and informational services, and paid services through which the user may gain access to the World Wide Web.

Figure 5:
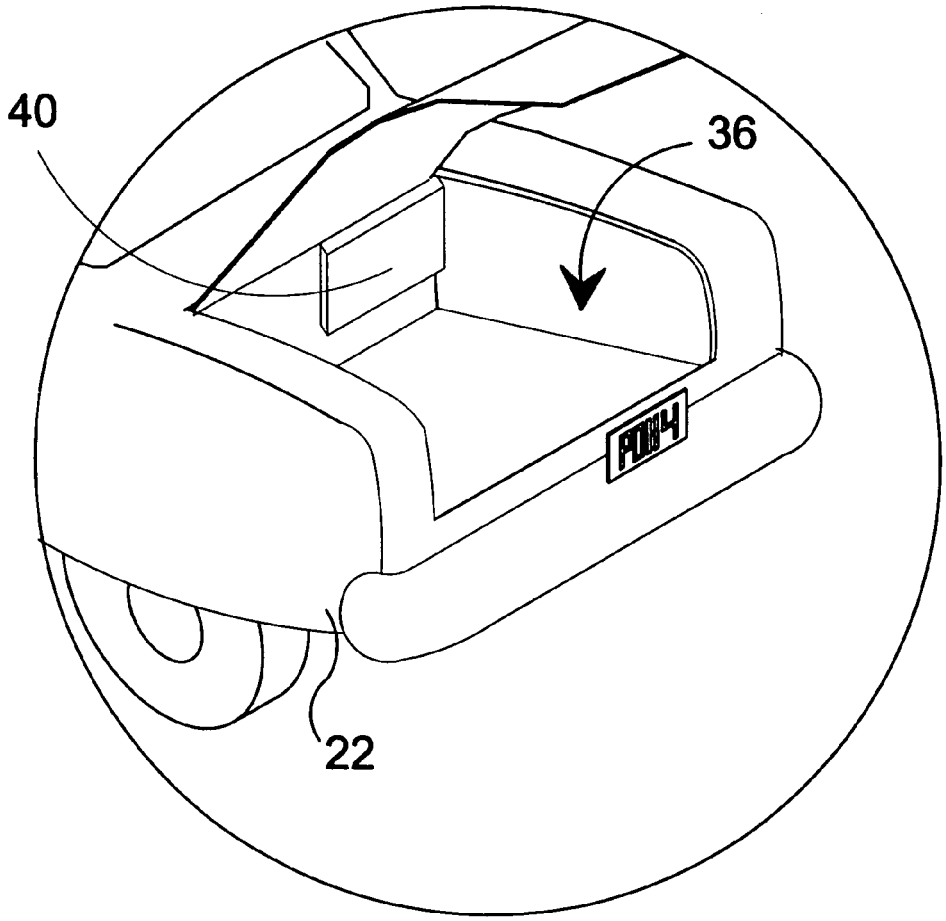
FIG. 5 is an illustrative view of the processor of the interactive public transportation information system of the present invention.

FIG. 5 is an illustrative view of the processor of the interactive public transportation information system of the present invention. The processor 40 of the system 10 of the present invention is fixed to the interior of the truck of a vehicle 22. The positioning of the processor 40, while depicted on the back wall of the truck, can be located in any area found unobtrusive to the storage of articles. The positioning shown herein provides optimal protection for the processor 40 from any inclement weather elements when the cover for the trunk is opened. Additionally, it is preferably that the processor 40 be protected by a protective device to prevent inadvertent damage when a user places articles in the truck. A further advantage of placing the processor 40 in the trunk is the ease with which the processor 40 can be accessed in order to perform maintenance and/or upgrade as deemed necessary.

Figure 6:
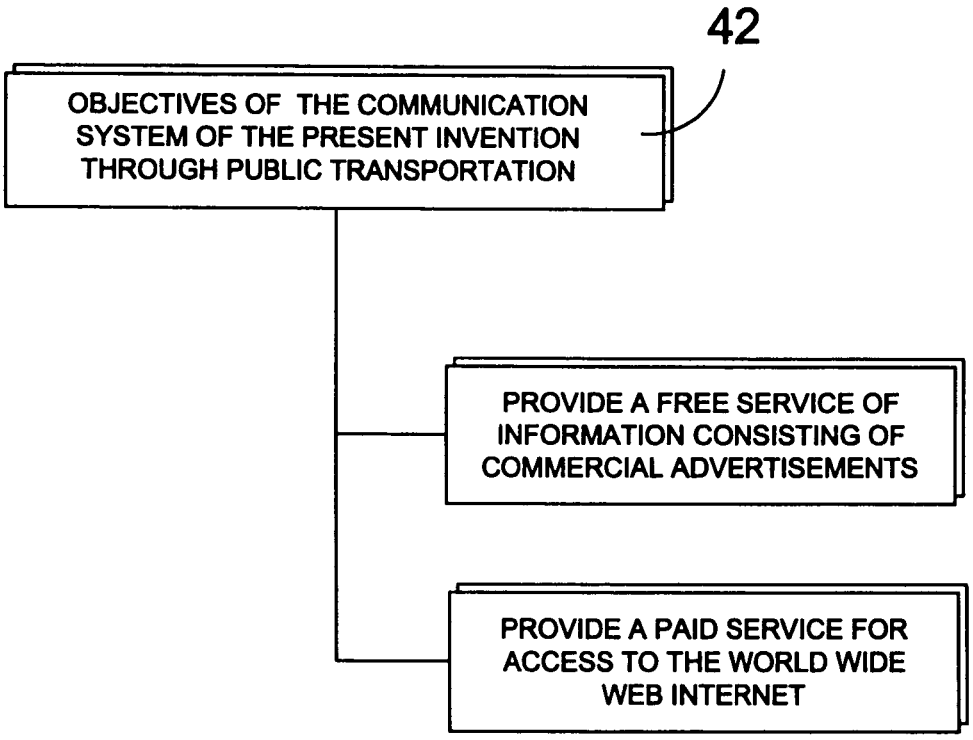
FIG. 6 is a block diagram of the communication system of the interactive public transportation information system of the present invention.

FIG. 6 is a block diagram of the communication system of the interactive public transportation information system of the present invention. The objects 42 of the system 10 of the present invention are partially described herein. The present invention utilizes public transportation to provide a information to users via a communication. The system provides both, free service communications and informational service, and a paid service in which the user may gain access to the World Wide Web. If the service provided by the system 10 is free, then the system 10 shows a plurality of advertisements from local merchants and service providers along with the information. Revenue paid by each merchant and or service provider allows the geographically pertinent information provided to remain free. Additionally, the users can elect to see advertisement free information by utilizing the payment device and paying a predetermined fee. Additionally, the system may incorporate a combination system whereby some content provided is free of charge and other content requires the input and verification of a method of payment.

Figure 7:
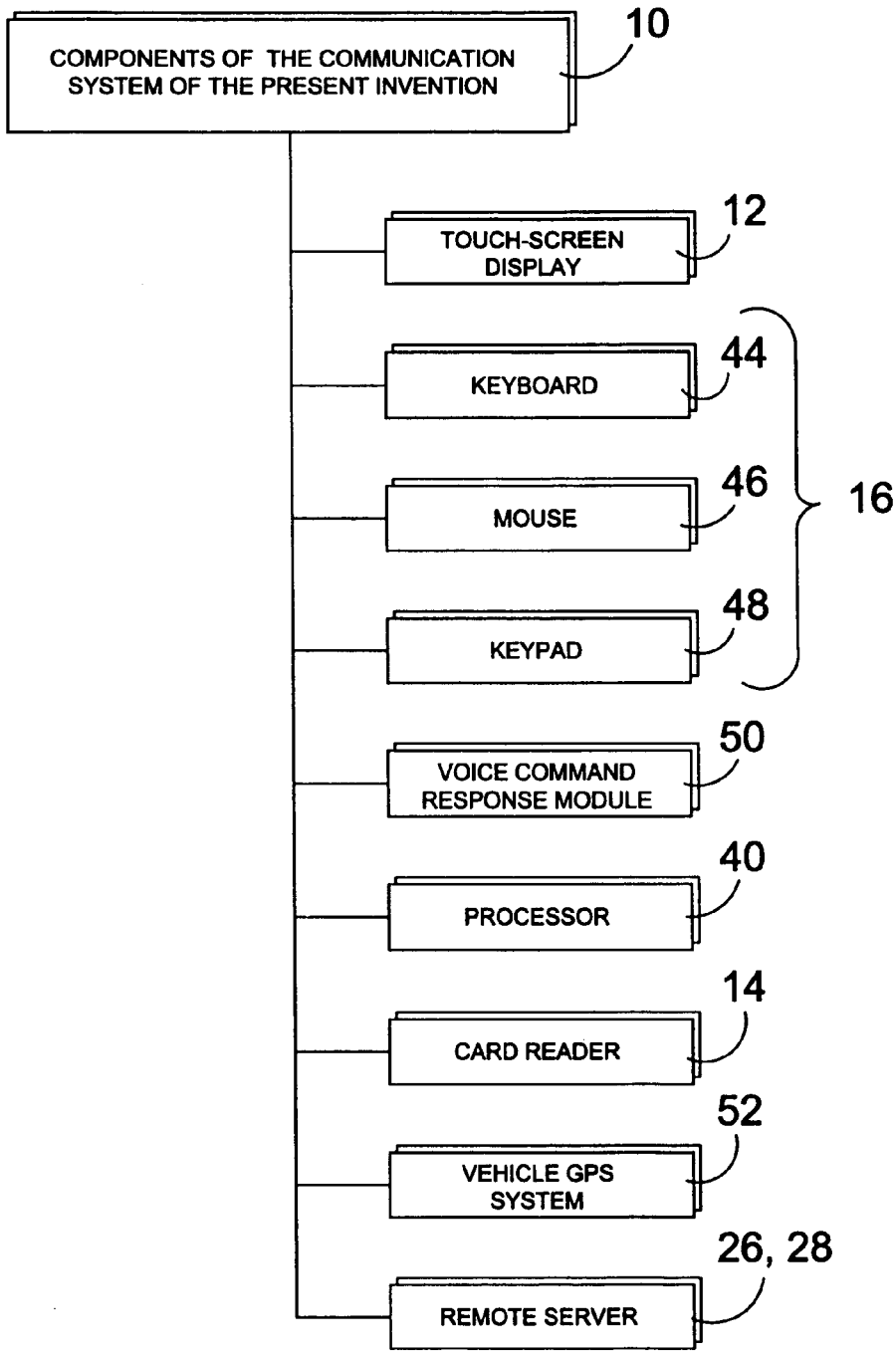
FIG. 7 is a block diagram of the components of the interactive public transportation information system of the present invention.

FIG. 7 is a block diagram of the components of the interactive public transportation information system of the present invention. The system 10 of the present invention includes in-vehicle components and remote components that communicate and interact with one another to provide geographically pertinent information to a user. The in-vehicle components include at least one touch-screen display 12 and a corresponding user interface 16. The user interface 16 includes at least one of a keyboard 44, mouse 46, keypad 48 and voice command response module 50. Additionally, the system 10 includes a processor 40 which is connected to each of the display and any and all user interface 16 components. Additionally, the in-vehicle components include a GPS system 52 that is at least one of formed integral with the processor 40 and connected to the processor 40. The remote components include the remote server 28 and the service provider 26.

The user is able to use any of the user interface 16 components to control the processor 40 to instruct the system 10 to retrieve information from the remote components 26,28. In addition to the geographically pertinent information, the system 10 can search for and acquire any desired information available on the internet.

Figure 8:
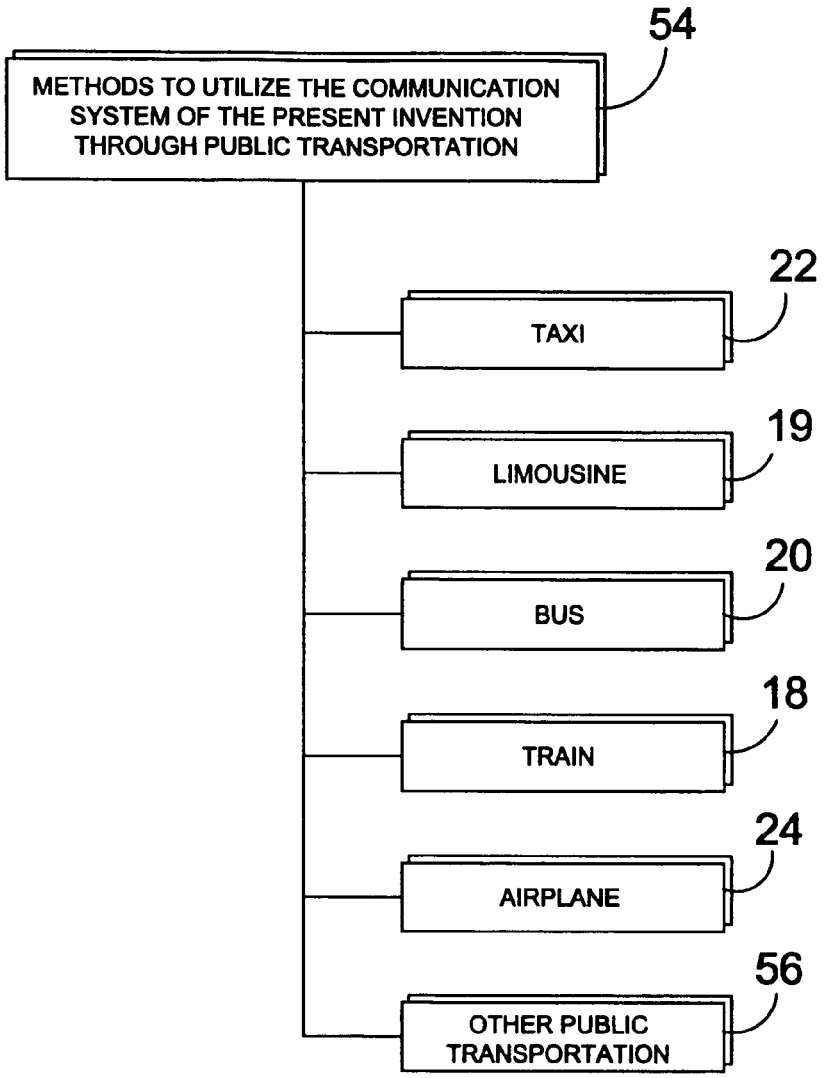
FIG. 8 is a flow diagram detailing how the interactive public transportation information system is operated.

FIG. 8 is a block diagram of the vehicles used by the interactive public transportation information system. The types of vehicles that the system 10 of the presnt invention can be used with are detailed herein. Specifically, the system 10 of the present invention public and private vehicles that are part of a centrally controlled fleet. The public and private vehicles include at least one of taxis 22, limousines 19, buses 20, trains 18, airplanes 24 and other public transportation vehicles. Alternatively, individual vehicles, not part of a fleet, could include a system and the system 10 can provide for log-in access to a central server.

Figure 9:
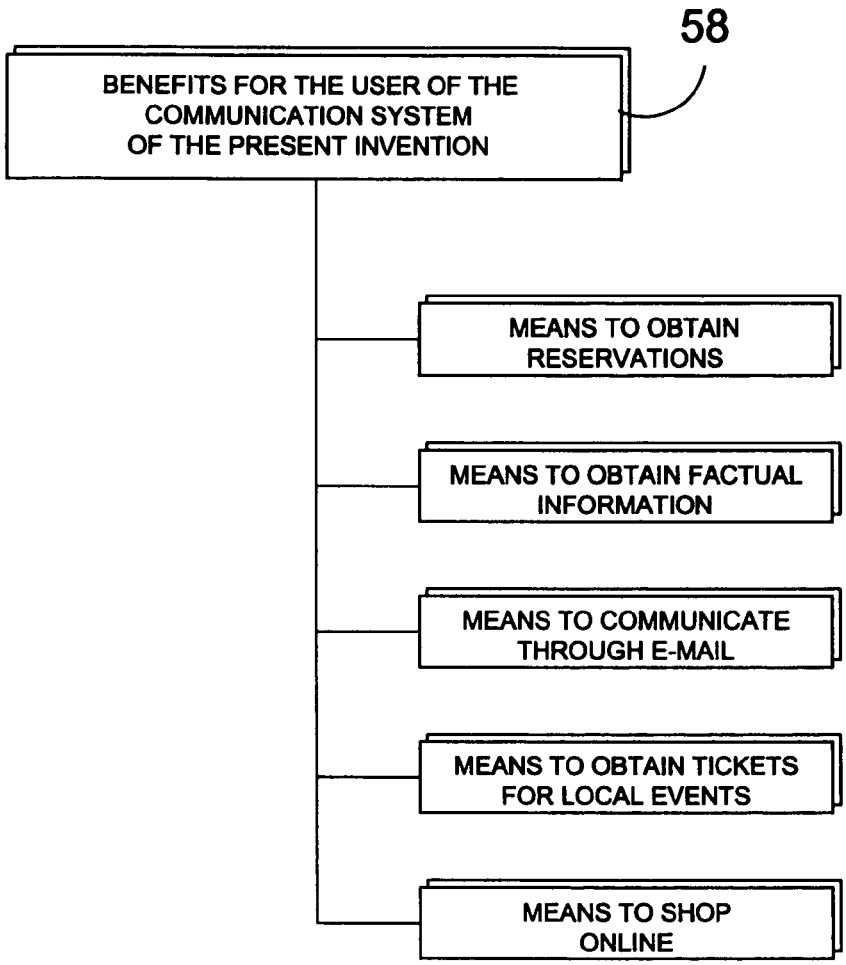
FIG. 9 is a block diagram detailing the benefits of the interactive public transportation information system of the present invention.

FIG. 9 is a block diagram detailing the benefits of the interactive public transportation information system of the present invention. The benefits 58 of the system 10 of the present invention include allowing a user to obtain reservations at a restaurant or obtain tickets to an event that is located proximate to the vehicle 22. The system 10 of the present invention further allows the user to obtain factual information about the area in which he/she is located. A user accessing the system may also be allowed to utilize an e-mail application over a secure connection. Furthermore, the system 10 of the present invention allows a user to make various purchases via the World Wide Web. These benefits 58 are described for purpose of example only.

Figure 10:
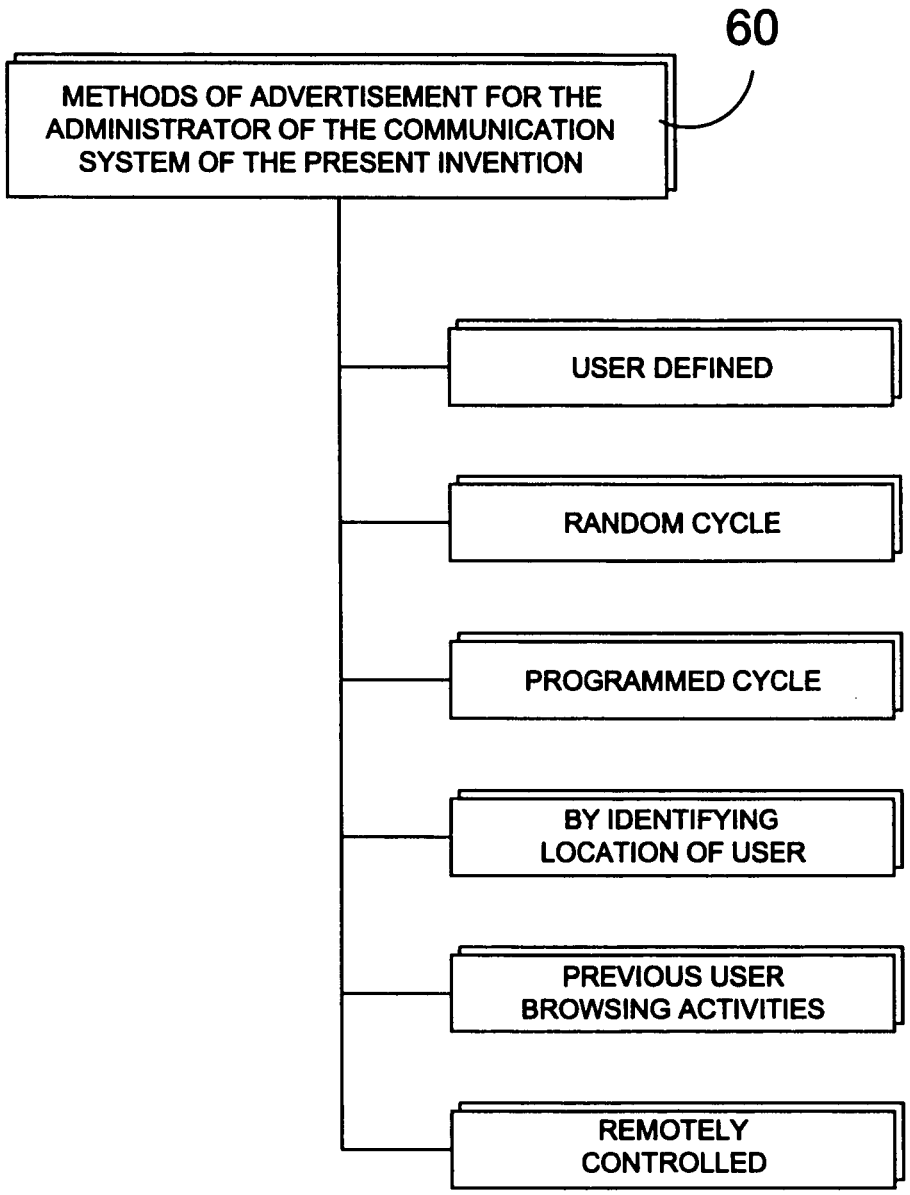
FIG. 10 is a block diagram detailing the method of advertisement used by the interactive public transportation information system of the present invention.

FIG. 10 is a block diagram detailing the method of advertisement used by the interactive public transportation information system of the present invention. This method of advertising described herein allow for the system 10 to be provided without the user paying for access thereto. The cost of the system is offset by the advertisement revenue received from a plurality of vendors. Specifically, upon obtaining advertisements for display on the display 12 of the system 10, rules exist defining the manner in which the advertisements actually reach the consumers. The methods able to be used by the system 10 of the present invention include user defined advertisements wherein the advertisement displayed on the monitor can be adjusted to suit individual users. Additionally, the advertising may be presented in at least one of a random cycle, a preprogrammed cycle, by user location, and/or by user activities. The control for the display of the advertising is controlled by at least one of processor 40, the remote server 28 and the service provider 26. However, the content of the advertisement is stored on the remote server and the obtained by the processor 40 whereby the processor 40 causes the obtained content to be immediately displayed according the a rule associated therewith. Alternatively, the processor 40 obtains the information and stores the information thereon for later display according to at least one of an obtained rule and a local rule governing the display of advertisements.

Figure 11:
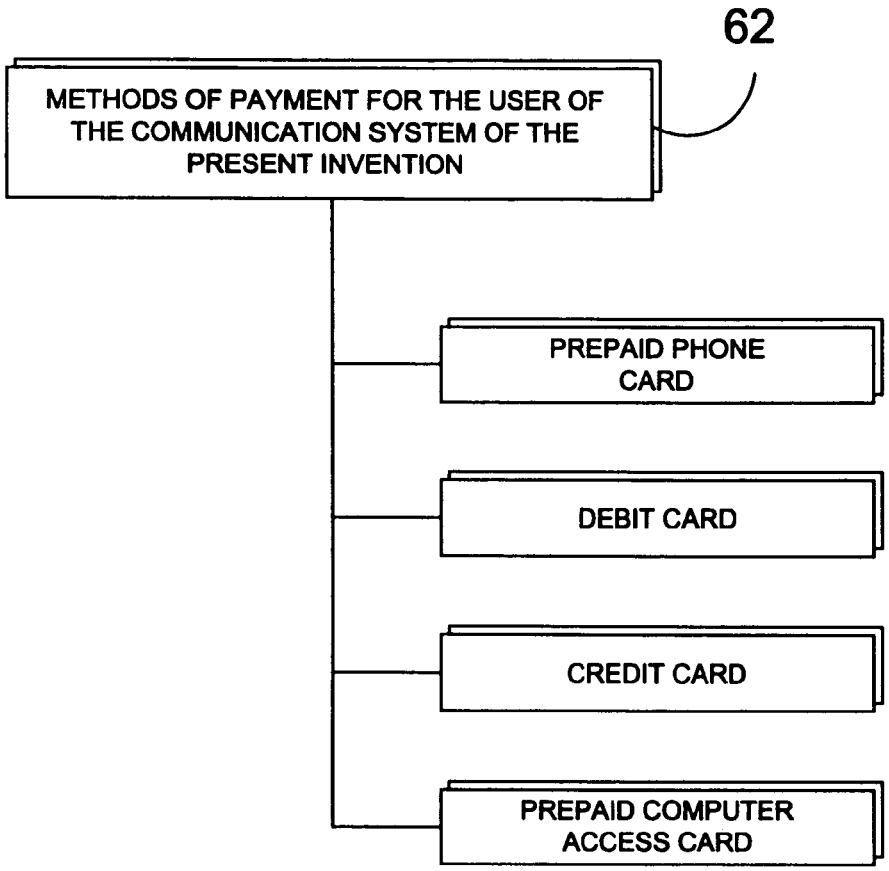
FIG. 11 is a block diagram detailing the method of payment used by the interactive public transportation information system of the present invention.

FIG. 11 is a block diagram detailing the method of payment used by the interactive public transportation information system of the present invention. The system 10 of the present invention may include a pay-per-service feature whereby the user is required to pay to access at least part of the content provided thereby. The user can pay via at least one of a pre-paid telephone cards, debit cards, credit cards, and by pre-paid computer access cards.

Figure 12:
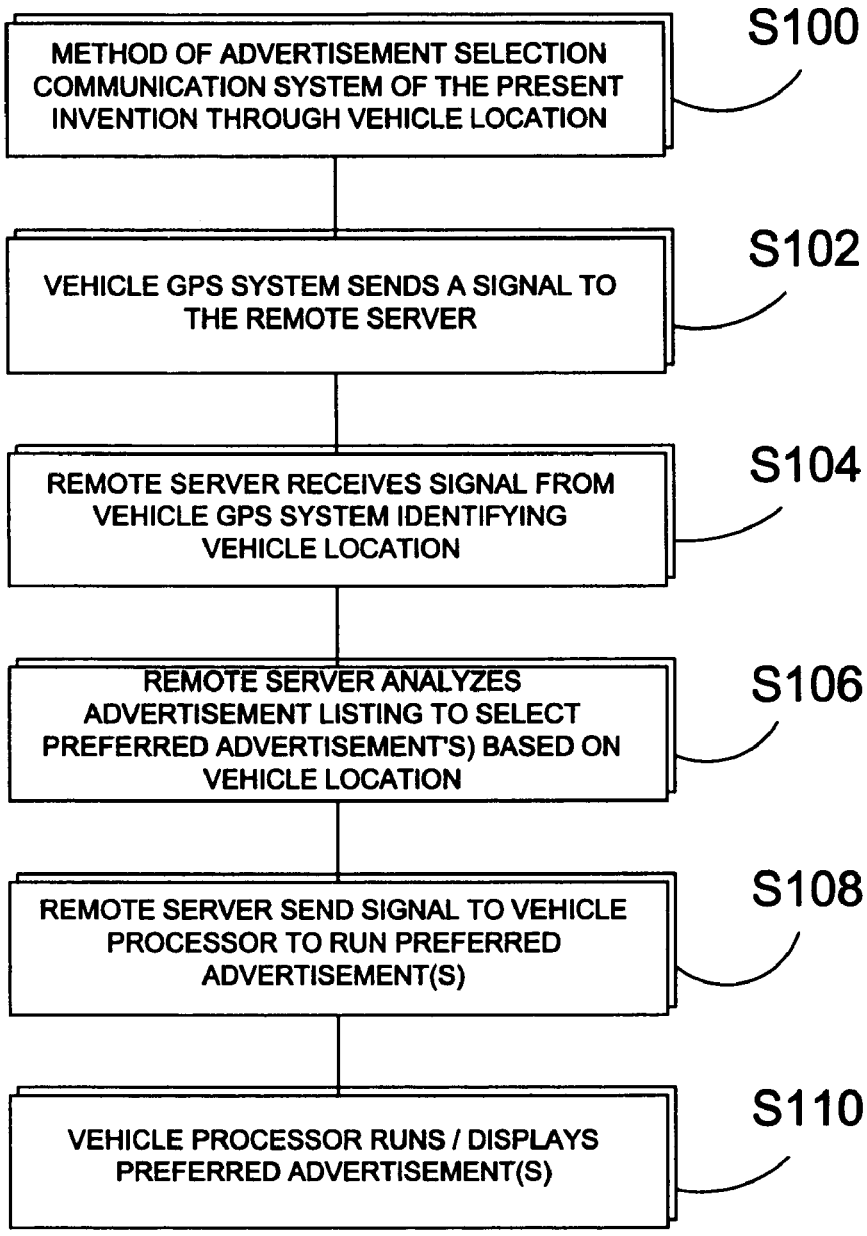
FIG. 12 is a flow chart detailing a method of local advertisement used by the interactive public transportation information system of the present invention.

FIG. 12 is a flow chart detailing a method of local advertisement used by the interactive public transportation information system of the present invention. Depicted in step S100 is the means for the system to identify preferred advertisement based on the location of the user. In step S102, the vehicles GPS system allows the remote server to signal the remote server. The remote server receives the signal in step S104 and is able to determine the geographic location of the vehicle therefrom. Thereafter, in step S106, the server analyzes advertisement content according to a plurality of predetermined rules to select preferred advertisement content stored thereon. Upon selecting the desired content, the remote server transmits a data signal to the requesting vehicle in step S108 which is received by the vehicle processor. Finally, in step S110, the vehicle processor causes the received advertisement to be displayed for the user on a display screen.

Figure 13:
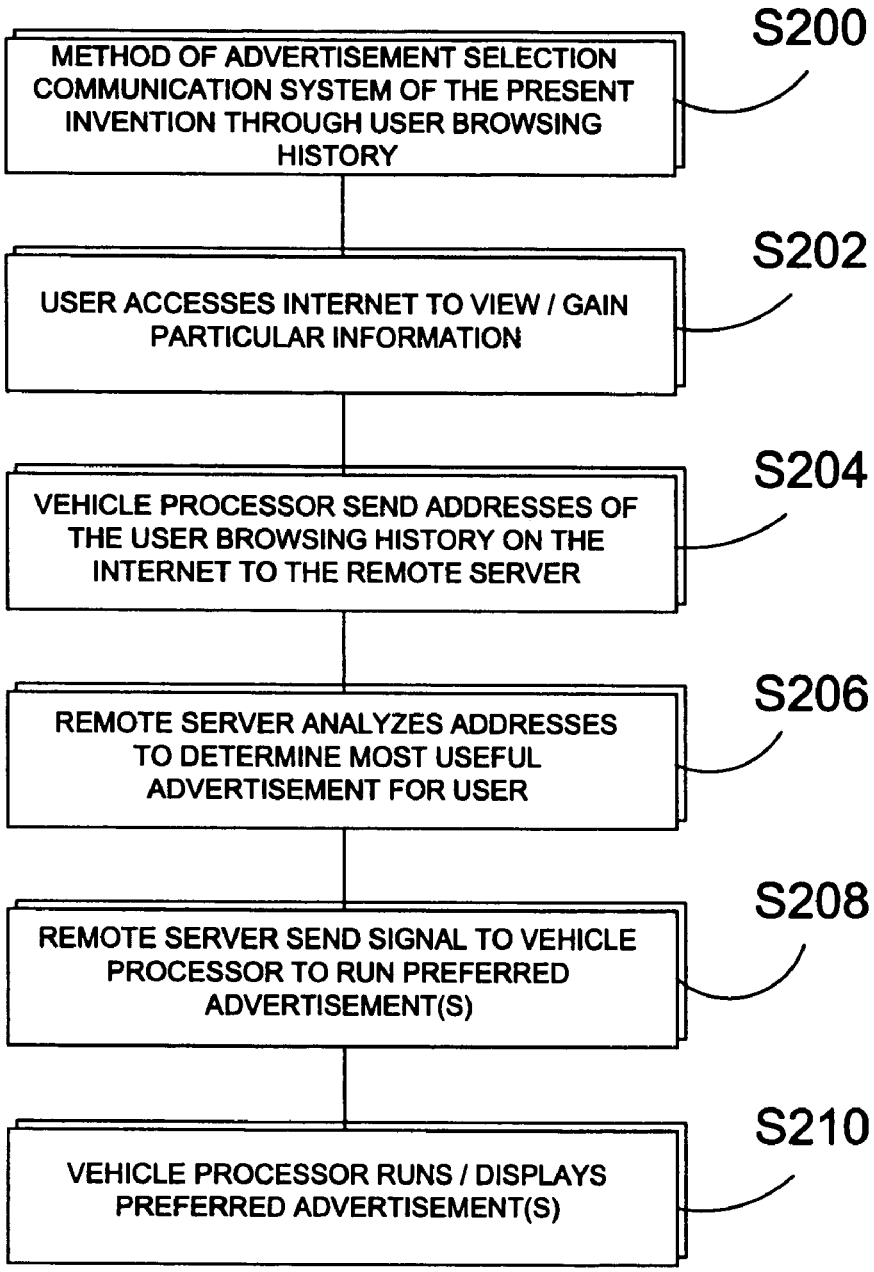
FIG. 13 is a flow chart detailing a method of advertisement based on user browsing history used by the interactive public transportation information system of the present invention.

FIG. 13 is a flow chart detailing a method of advertisement based on user browsing history used by the interactive public transportation information system of the present invention. The method shown beginning in step S200 details how advertisement is provided to a user based on the browsing history of the user. In step S202, the user utilizes the system 10 to access the internet to acquire desired information. The vehicle processor captures the address accessed and provides the addresses to the remote server in step S204. The remote server, in step S206, analyzes the addresses received and selectively determines most useful advertisement based on a predefined criteria. Upon determining the most useful advertisement, the remote server transmits a data signal representing the advertisement to the vehicle processor in step S208. The vehicle processor then displays the advertisements on a display in step S210.

FIG. 14 a block diagram of the communication system of the interactive public transportation information system of the present invention. As described above with respect to FIG. 1, the system 10 of the present invention provides a plurality of types of information to a user when the user is riding in a public transportation vehicle. FIG. 2 shows how the system 10 of the present invention obtains, transmits and provides information to a plurality of vehicles. Specifically, shown herein there are four vehicles 22 that may be part of a fleet of public transportation vehicles. The fact that only four vehicles 22 are shown herein does not mean to limit the use of the system to four vehicles 22. The system 10 can be designed to incorporate any number of vehicles 22.

In addition to the in-vehicle components described above with respect to FIG. 1, the system 10 of the present invention further includes a remote server 28 and a service provider 26. Each of the remote server 28 and the service provider 26 are connected to one another as well as to an external communication network 32 by the internet. Preferably, the connections between each of the remote server 28, the service provider 26, the internet 30, the communication network 32 and each of the vehicles 22 is a high-speed broadband connection able to quickly and reliably transfter data therebetween.

The service provider 26 is the initial distribution point for the information being provided to the vehicles 26. The remote server 28 includes a storage mechanism and/or a database having information stored therein which is then provided, by the service provider 26, to at least one of a plurality of vehicles and to an external communication network 32. The remote server 28 includes a plurality of predetermined rules which govern the type of information provided by the system 10 of the present invention.

Additionally, the system 10 includes a global positioning system (GPS) whereby each of the vehicles 22 have a GPS receiver which is in constant communication with a GPS satellite for selectively determining the geographical location of each respective vehicle 22. The position of each vehicle is provided to the service provider which then in turn accesses the remote server 28 to retrieve information based on the geographic location. Upon retriving the geographically pertinent information from the remote server 28, the service provider 26 provides the information to the vehicle via data signals 34 wherein each respective data signal provided represents specifically requested information. The system is designed such that the service provider 26 and remote server 28 are able to handle multiple simultaneous requests from a plurality of users 11 in a plurality of vehicles.

In addition to pertinent geographic information, the system 10 of the present invention provides a user with internet access.

Furthermore, if the system 10 of the present invention is a pay-per-use system, the service provider 26 receives and processes the payment information input by the user 11 and selectively verifies that a payment is made. Thereafter, the service provider 26 function as described hereinabove and provides at least one of geographically pertinent information and internet access to a user in a respective one of a plurality of vehicles.

The system 10 of the present invention further provides a mechanism formed integral with the processor 40 allowing a user to communicate with the driver using language translation software. The software maybe aftermarket software or stored in a ROM contained within the processor. Additionally, the software is upgradeable to include a plurality of languages.

FIG. 15 is a block diagram of the passenger interface 16 of the interactive public transportation information system of the present invention. The passenger interface includes the display 12 and the user interface 16. The user interface 16 includes at least one of a touch screen 47, key pad 48, keyboard 44 and mouse 46 that can be used in conjunction with the display for interactive communication with at least one of the processor 40 and the remote server 28 via the service provider 26.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A information providing system for use in a fleet of public transportation vehicles comprising:

a. a processor having a global positioning system (GPS) incorporated therein positioned at a predetermined location within each said vehicle;

b. a passenger interface positioned fixed within each said vehicle and connected to said processor for controlling said processor;

c. a service provider located remotely from said vehicles for distributing content to each said processor;

d. a remote server storing a database containing geographic based information;

e. a communication network for connecting said service provider to each said processor; wherein said GPS obtains information regarding a current geographic location of each said vehicle and provides said information to said service provider for analysis thereof, said service provider accessing said remote server to retrieve information based on the geographic location of a processor in a particular vehicle and distributing geographically pertinent content to said processor for display on each said passenger interface for access by a passenger;

f. said system being simultaneously in use in a plurality of different vehicles, said service provider being able to receive and respond to a plurality of information requests from a plurality of passengers in different vehicles in different locations; and g. each said passenger being able to access said geographical pertinent content without accessing the internet directly; and h. an external communication network communicating with each vehicle for directly connecting a processor and passenger interface to the internet for data retrieval therefrom, each of the remote server and service provider connected to one another as well as the external communication network by the internet.

2. The system as recited in claim 1, wherein said content is information representing at least one of merchants, service providers, news, sports scores, traffic information, events within a geographical area of each said vehicle.

3. The system as recited in claim 2, wherein said content is stored according to the geographic location of the origin thereof for indexing by said service provider for use in distributing said content.

4. The system as recited in claim 3, wherein said content includes advertising content provided by at least one merchant intended for display to user within a predetermined distance from said merchant and information content.

5. The system as recited in claim 4, wherein said service provider utilizes said GPS information to selectively determine whether said vehicle is positioned within said predetermined distance.

6. The system as recited in claim 5, wherein upon receiving said GPS information, said service provider further comprises a plurality of predetermined rules for selecting said content from said stored content.

7. The system as recited in claim 6, wherein said predetermined rules include at least one of random display of content, pre-programmed display of content, further geographical identification of a user and a user defined content rule.

8. The system as recited in claim 7, in which each vehicle has a payment mechanism wherein said payment mechanism is able to receive at least one of a credit card number, a debit card, a phone card and a pre-paid computer access card obtained from said service provider allowing a passenger to pay for internet access or obtain other services requiring payment.

9. The system as recited in claim 8, wherein said processor is able to capture web browsing information and transit said web browsing information via said communication network to said service provider.

10. The system as recited in claim 9, wherein said passenger interface includes a display and a tactile mechanism.

11. The system as recited in claim 10, wherein said display is a touch screen display for allowing a user to control said processor.

12. The system as recited in claim 10, wherein said tactile mechanism is at least one of a keyboard, a keypad and a mouse.

13. The system as recited in claim 12, wherein said passenger interface is positioned on a rear side of a seat positioned in front of the user.

14. The system as recited in claim 13, wherein said vehicle includes at least one of a automobile, train, bus, monorail, airplane, trolley, and boat.

15. The system as recited in claim 14, wherein said communication network is at least one of the internet and a satellite communication network.

16. The system as recited in claim 15, wherein said processor further comprises a software module able to translate between a plurality of different languages.

* * * * *